US006164036A

United States Patent [19]

Manser

[11] Patent Number: 6,164,036

[45] Date of Patent: Dec. 26, 2000

[54] FLEXIBLE RADIUSED CORNER KEY FOR INSULATED GLASS ASSEMBLIES

[75] Inventor: Russell D. Manser, Fenton, Mich.

[73] Assignee: Atwood Mobile Products, Inc., Rockford, Ill.

[21] Appl. No.: 09/229,238

[22] Filed: Jan. 12, 1999

[51] Int. Cl.[7] ..... E04C 2/38

[52] U.S. Cl. ..... 52/656.9; 52/658; 52/717.03; 403/295

[58] Field of Search ..... 52/786.1, 786.13, 52/658, 656.9, 717.03; 403/295

[56] References Cited

U.S. PATENT DOCUMENTS

| | | | |
|---|---|---|---|
| 2,708,774 | 5/1955 | Seelen . | |
| 2,768,475 | 10/1956 | Seelen et al. . | |
| 2,872,713 | 2/1959 | Haas . | |
| 2,989,788 | 6/1961 | Kessler . | |
| 3,427,055 | 2/1969 | Jureit et al. . | |
| 3,706,173 | 12/1972 | Taylor | 52/717.03 |
| 4,067,655 | 1/1978 | Mayerhofer . | |
| 4,183,693 | 1/1980 | Berdan . | |
| 4,296,587 | 10/1981 | Berdan . | |
| 4,530,195 | 7/1985 | Leopold . | |
| 4,571,115 | 2/1986 | Erlebach et al. . | |
| 4,608,802 | 9/1986 | Bayer . | |
| 4,822,205 | 4/1989 | Berdan . | |
| 5,026,581 | 6/1991 | Shea, Jr. et al. . | |
| 5,048,997 | 9/1991 | Peterson | 52/656.9 X |
| 5,263,594 | 11/1993 | Bianchi . | |
| 5,447,761 | 9/1995 | Lafond | 52/786.13 X |
| 5,617,699 | 4/1997 | Thompson, Jr. . | |
| 5,644,894 | 7/1997 | Hudson . | |
| 5,679,419 | 10/1997 | Larsen . | |

FOREIGN PATENT DOCUMENTS

| | | | |
|---|---|---|---|
| 3344555 | 6/1985 | Germany | 52/656.9 |

*Primary Examiner*—Beth A. Stephan
*Assistant Examiner*—Brian E. Glessner
*Attorney, Agent, or Firm*—Porter Wright Morris & Arthur

[57] ABSTRACT

The invention is a flexible corner piece for use in the construction of a spacer frame for insulated glass panels. The corner piece is provided with opposing end sections suitable for mating with spacer tubes. In addition, the flexible corner piece has a variably flexible center section having a smooth and contiguous outer face opposing a parallel serrated face, thereby allowing the corner piece to flex along a variable radius.

13 Claims, 2 Drawing Sheets

FIG-3A
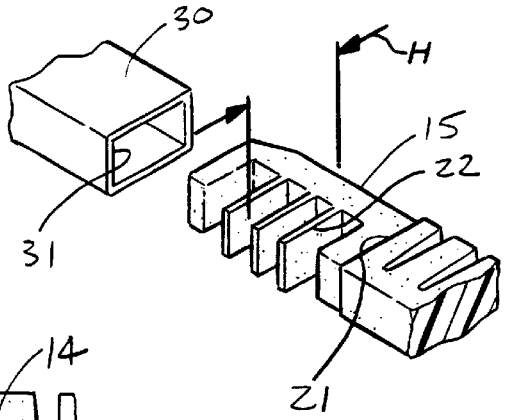
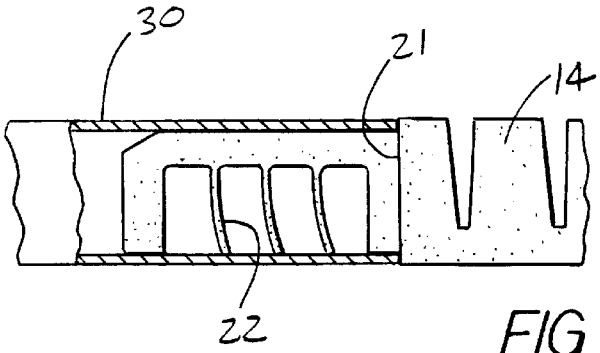
FIG-3B
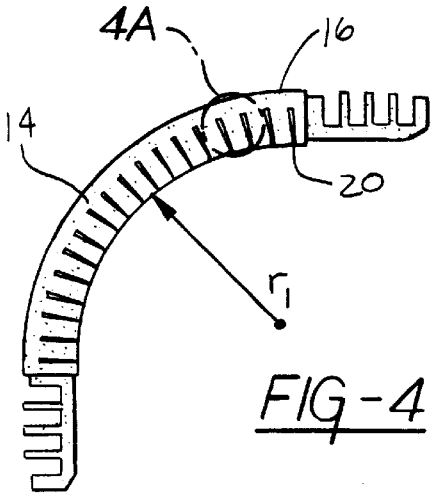
FIG-4
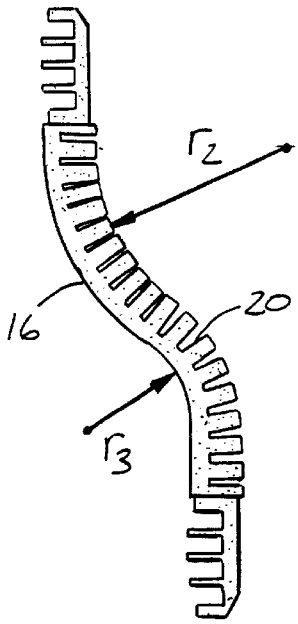
FIG-5
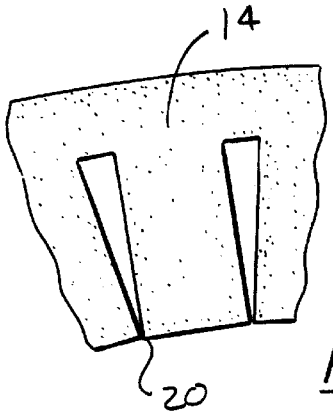
FIG-4A

FLEXIBLE RADIUSED CORNER KEY FOR INSULATED GLASS ASSEMBLIES

FIELD OF THE INVENTION

This invention relates to the field of multiple pane insulating windows, and, in particular relates to an improved flexible corner connector piece for joining adjacent spacer elements which are used to separate the panes of a multiple pane window.

BACKGROUND OF THE INVENTION

Insulating glass panes of the type commonly used as glazing in windows and doors are normally constructed by sandwiching a spacer frame assembly between sheets of glass, and thereafter bonding the sheets to the spacer frame assembly to form an air-tight seal. While, in the past, finished panels were typically square or rectangular, there has been substantial growth in popularity of finished panels having rounded or radiused corners, rather than sharp angles.

It is well known in the art to provide spacer frame assemblies between sheets of glass which consist of several relatively rigid and usually straight spacer tubes, interconnected by a plurality of corner pieces or corner keys. Typical corner keys are disclosed, for example, in U.S. Pat. No. 2,989,788, issued to Kessler; U.S. Pat. No. 4,530,195, issued to Leopold; and U.S. Pat. No. 4,822,205, issued to Berdan. Such keys may be rigid (Mulligan and Kessler), or flexible (Leopold, Berdan). Flexible keys are typically manufactured from appropriately flexible thermoplastics, and may be provided with a locking or positioning mechanism to insure the creation of a precise angle. See, for example, Leopold, or U.S. Pat. No. 5,048,997, issued to Peterson.

Heretofore, however, flexible corner keys, such as those taught by Leopold and Peterson, have been unacceptable in many installations, insofar as they tend to create a relatively sharp corner.

Along with the growth and popularity of finished panels having rounded or radiused corners, there have been an increased need for corner keys suitably, adapted to the useful and aesthetically pleasing large radiuses.

SUMMARY OF THE INVENTION

The present invention provides a flexible corner piece for use in the construction of a spacer frame for insulated glass panels which overcomes the above problems. Specifically, the flexible corner piece is provided with opposing end sections suitable for mating with spacer tubes. In addition, the flexible corner piece of the present invention has a variably flexible center section having a smooth and contiguous outer face, opposing a parallel, serrated face provided with suitable serrations thereby allowing the corner piece to flex along a variable radius.

DETAILED DESCRIPTION OF THE DRAWINGS

FIG. 3A is a cross-sectional view of the interface between the spacer tube and corner piece of the present invention.

FIG. 3B is a perspective assembly view of the elements of FIG. 3A depicted separately.

FIG. 4 is a plan view of the corner piece according to the present invention shown with a single simple radiused curvature, with detail shown at FIG. 4A.

FIG. 5 is a plan view of the corner piece of the present invention showing a compound curve.

DESCRIPTION OF THE PREFERRED EMBODIMENT

Figure 1:
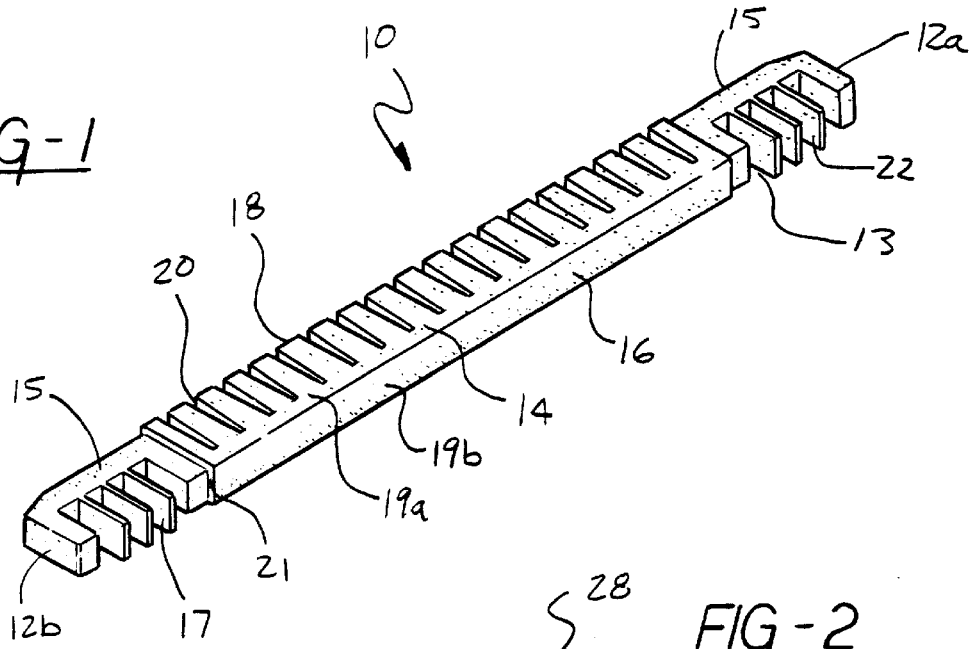
FIG. 1 is a perspective view of a corner piece according to the present invention.

The invention can best be understood by initially referring to FIG. 1, which shows a corner piece 10 having the following attributes:

Corner piece 10 is provided with opposing ends sections 12A and 12B having relieved portions 13. Affixed to longitudinal elements 15 of end portions 12, are tabs 22 which protrude perpendicular to inner surface 17. The corner piece 10 has a center section 14, in turn having a contiguous, uninterrupted surface 16 which is perpendicular to front and rear sides 19A and 19B. Opposite surface 16 is opposing surface 18, which is interrupted by a plurality of serrations 20 which are interspersed along the length of center portion 14. Serrations 20 are in the form of slots having substantial depth, thereby imparting flexibility to corner piece 10.

Figure 2:
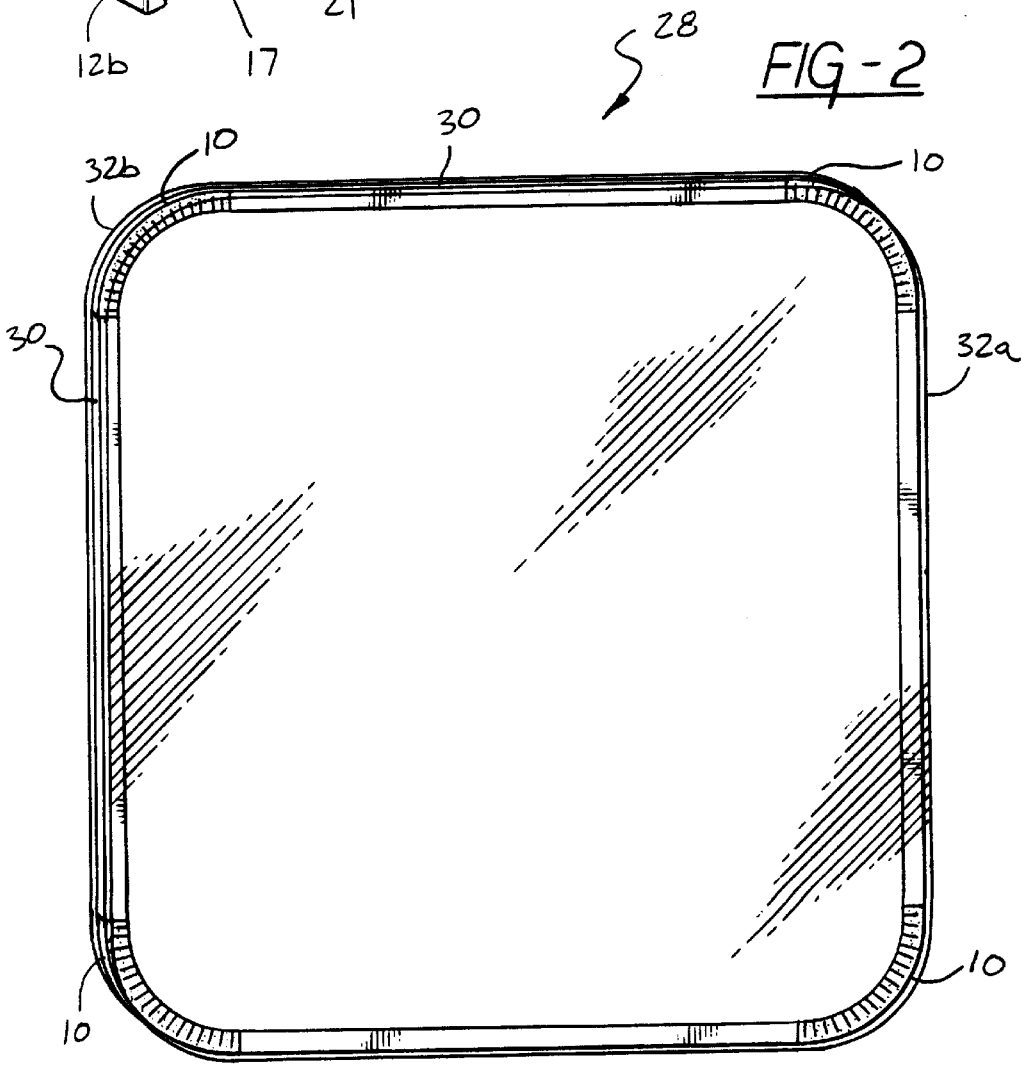
FIG. 2 is a perspective view of a glass panel assembly incorporating a spacing assembly utilizing corner pieces according to the present invention and describing the spacer assembly of the present invention.

As shown in FIG. 2, a plurality of corner pieces 10 serve to interconnect a plurality of spacer tubes 30 to form a spacer assembly which is placed between panes of glass 32A and 32B, thereby creating an air space. A sealant (not shown) is applied to the spacer assembly consisting of spacer tubes 30 and corner pieces 10 prior to assembly of glass panes 32A and 32B, trapping a volume of air between glass panes 32A and 32B and the spacer assembly. In the preferred embodiment, a dessicant (not shown) is applied to the inner surface of the spacer assembly, attracting and binding any water molecules in the air space between panes 32A and 32B to prevent fogging of the glass.

Referring now to FIGS. 3A and 3B, the interface between the corner piece 10 and spacer tube 30 can be better understood. In the preferred embodiment, inserted end section 12 of corner piece 14 is inserted into an open end of spacer tube 30, which is preferably, but not necessarily, rectangular in cross-section. Tabs 22 are formed or affixed on end 12. The dimension of the thickness of the longitudinal extension 15 and the length of tab 22 selected to insure that the dimension H shown in FIG. 3A is slightly greater than the corresponding inside dimension of the tube 30. In this fashion, insertion of end 12 into the open end of tube 30 results in a frictional fit of end section 12 inside to remain in fixed engagement with the interior of tube 30. In the preferred embodiment, center section 14 has a height and width substantially similar to the external height and width of the tube 30. End sections 12, however, have an overall height and width which corresponds to the internal height and width of tube 30. These dimensional differences between body 14 and end sections 12 creates a shoulder portion 21 which abuts the end surfaces 31 of tube 30 when corner piece 10 is fully inserted into tube 30.

Referring now to FIG. 4, the importance of serrations 20 will be best understood. Serrations 20 are preferably formed as slots in body 14, by removal of small portions of body portion 14 by virtue of molding techniques, cutting, sawing or other well known processes. These slots can be appreciated in detail as shown in FIG. 4A. By virtue of the empty spaces existing as a result of this slotting, the body portion 14 of corner piece 10 may easily be flexed. By selecting material for the corner piece 10 from the appropriate, class of thermoplastics, a flexible, resilient, deformable corner piece is achieved. Additionally, by regulating the number, position, width and depth of slots 20 in relation to body 14, varying degrees of flexibility and radius of curvature may be pre-determined.

In addition, as shown in FIG. 5, the corner piece 10 of the present invention is likewise capable of compound curvature. As shown in FIG. 5, the body 14 of corner piece 10 may be flexed so as to both compress and to distend slots 20 to create multiple radiuses (e.g., r2 and r3).

In the preferred embodiment, a plurality of corner pieces 10 are inserted to act as corner points in glass assemblies 28. By virtue of their flexibility, a single corner piece 10 may be formed into a wide variety of different radiuses, limited only by the amount of material removed from the total number of slots 20 found on the body 14. Further, when flexed, the corner piece presents a smooth and attractive contiguous exterior surface 16, and two substantially parallel support surfaces 19A and 19B for supporting opposing plates of glass.

Having thus described my invention in detail, numerous obvious improvements and modifications thereto may be made without departing from the essence of my invention, which I claim as follows:

What is claimed is:

1. In a flexible corner piece for joining together two or more spacer tubes used to separate multiple panes of glass, said corner piece comprising a pair of opposing end sections, each of said end sections adapted to mate with one end of each of said spacer tubes, and a flexible section disposed between said opposing end sections, the improvement comprising:

said flexible center section further comprising a contiguous outer face and a parallel serrated opposing face, said serrated opposing face provides with a plurality of parallel serrations along a substantial portion of the length of said corner piece whereby a substantial portion of the length of said corner piece is flexible, and wherein said serrations are formed along a portion of the length of said corner piece having a length longer than a length of at least one of the end sections.

2. The flexible corner piece according to claim 1, wherein said corner piece is deformable tangent to said outer face and said opposing face to create a smoothly radiused outer face.

3. In a flexible corner piece for joining together two or more spacer tubes used to separate multiple panes of glass, said corner piece comprising a pair of opposing end sections, each of said end sections adapted to mate with one end of each of said spacer tubes, and a flexible center section disposed between said opposing end sections, the improvement comprising:

a variable radiused flexible center section comprising a contiguous outer face and a parallel serrated opposing face, said serrated opposing face provided with a plurality of serrations which are parallel and spaced apart when said corner piece is in an unrestrained condition and are adapted to impart flexibility to said center section.

4. A spacer assembly for multiple panes of glass, said spacer assembly comprising, in combination:

a plurality of spacer tubes each adapted to accept at least one end of a flexible corner piece, said flexible corner piece comprising a pair of opposing end sections, each of said end sections adapted to mate with one end of each of said spacer tubes;

a flexible center section disposed between said opposing end sections;

said flexible center section further comprising a contiguous outer face and a parallel serrated opposing face, said serrated opposing face provided with a plurality of plurality serrations along a substantial portion of the length of said corner piece whereby a substantial portion of the length of said corner piece is flexible, and wherein said serrations are formed along a portion of the length of said corner piece having a length longer then a length of at least one of the end sections.

5. The spacer assembly according to claim 4, wherein said corner piece is deformable tangent to said outer face and said opposing face to create a smoothly radiused outer face.

6. A spacer for multiple panes of glass comprising, in combination:

a plurality of spacer tubes each adapted to accept at least one end of a flexible corner piece, said flexible corner piece comprising a variable radiused center section comprising a contiguous outer face and a parallel serrated opposing face, said serrated opposing face provided with a plurality of serrations which are parallel and spaced apart when said corner piece is in an unrestrained condition and are adapted to impart flexibility to said center section.

7. A flexible corner piece for joining together two or more spacer tubes used to separate multiple panes of glass, said flexible corner piece comprising, in combination:

a pair of opposing end sections;

each of said end sections adapted to mate with at least one end of at least one of said spacer tubes;

a flexible center section disposed between said opposing end sections; and said flexible center section comprising a contiguous outer face and a parallel serrated opposing face, said serrated opposing face provided with a plurality of parallel serrations along a substantial portion of the length of said corner piece whereby a substantial portion of the length of said corner piece is flexible, and wherein said serrations are formed along a portion of the length of said corner piece having a length longer then a length of at least one of the end sections.

8. The flexible corner piece according to claim 7, wherein said corner piece is deformable tangent to said outer face and said opposing face to create a smoothly radiused outer face.

9. A flexible corner piece for joining together two or more spacer tubes used to separate multiple panes of glass, said flexible corner piece comprising, in combination:

a pair of opposing end sections;

each of said end sections adapted to mate with at least one end of at least one of said spacer tubes; and a variable radiused flexible center section comprising a continuous outer face and a parallel serrated opposing face, said serrated opposing face provided with a plurality serrations which are parallel and spaced apart when said corner piece is in an unrestrained condition and are adapted to impart flexibility to said center section.

10. The flexible corner piece according to claim 7, wherein said serrations are formed by a plurality of slots which are parallel and spaced apart when said corner piece is in an unrestrained condition.

11. The flexible corner piece according to claim 7, wherein said serrations are formed along a portion of the length of said corner piece having a length longer than a combined length of the end sections.

12. The flexible corner piece according to claim 7, wherein said serrations are formed along about ⅔ the length of said corner piece.

13. The flexible corner piece according to claim 9, wherein said serrations are formed by a plurality of slots which are parallel and spaced apart when said corner piece is in anunrestrained condition.

* * * * *